United States Patent [19]

Watkins

[11] Patent Number: 4,754,718

[45] Date of Patent: Jul. 5, 1988

[54] DOUBLE NEEDLE BAR TUFTING APPARATUS FOR THE FORMATION OF LOOP PILE AND CUT PILE

[75] Inventor: Charles W. Watkins, Ooltewah, Tenn.

[73] Assignee: Tuftco Corporation, Chattanooga, Tenn.

[21] Appl. No.: 62,901

[22] Filed: Jun. 16, 1987

[51] Int. Cl.[4] ..... D05C 15/22

[52] U.S. Cl. ..... 112/80.52

[58] Field of Search ..... 112/80.56, 80.55, 80.52

[56] References Cited

U.S. PATENT DOCUMENTS

| | | | |
|---|---|---|---|
| 2,879,729 | 3/1959 | McCutchen . | |
| 2,889,791 | 6/1959 | Fedevich . | |
| 2,990,792 | 7/1961 | Nowicki . | |
| 3,019,748 | 2/1962 | Card . | |
| 3,025,807 | 3/1962 | Gebert . | |
| 3,100,462 | 8/1963 | Rice | 112/80.52 |
| 3,155,059 | 11/1964 | Bryant | 112/80.52 |
| 3,241,507 | 3/1966 | Dedmon . | |
| 3,919,953 | 11/1975 | Card et al. | 112/80.52 |

*Primary Examiner*—Ronald Feldbaum

*Attorney, Agent, or Firm*—Harrington A. Lackey

[57] ABSTRACT

A multiple needle tufting machine incorporating a pair of front and rear needle bars each supporting corresponding front and rear needles in transverse rows for simultaneous penetration of a base fabric moving in a feeding direction through the machine. A looper apparatus is provided incorporating a front transverse cut pile hook bar supporting a plurality of cut pile hooks pointing in the direction opposite the feeding direction, and a loop pile hook bar spaced in front of the cut pile hook bar for supporting a plurality of loop pile hooks having bills projecting rearwardly in the feeding direction and opposite the direction of the bills of the cut pile hooks. The looper apparatus further includes a drive and linkage mechanism for simultaneously moving the cut pile hooks and loop pile hooks in opposite directions for cooperation with the corresponding front and rear needles, in order to form loop pile loops behind the cut pile tufts in the same base fabric.

13 Claims, 3 Drawing Sheets

FIG. 4
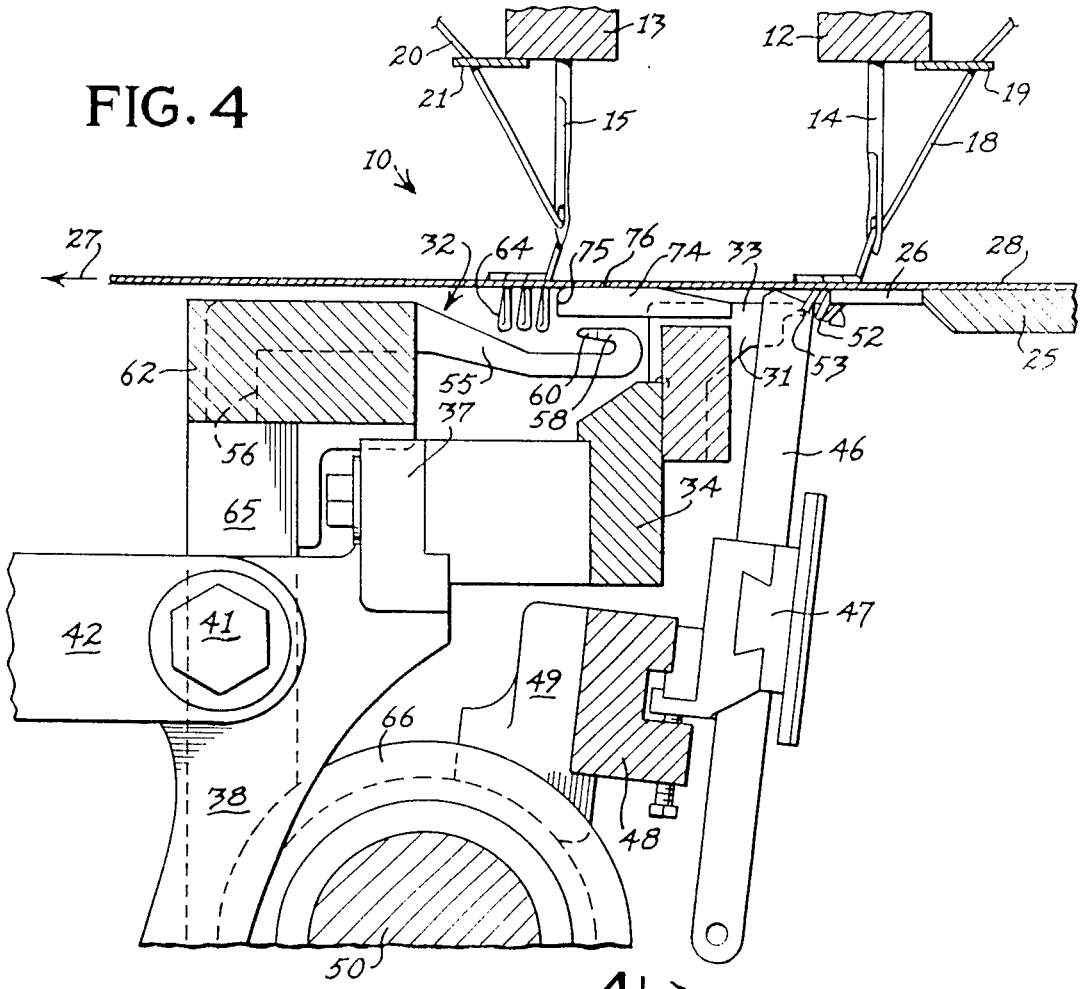
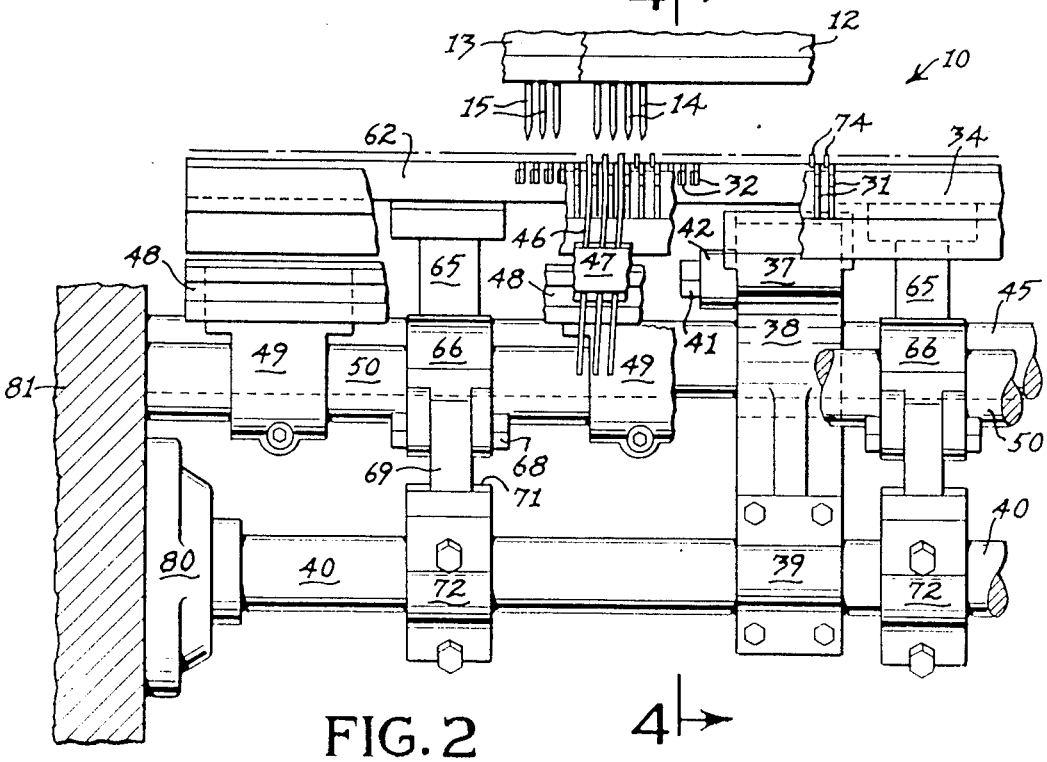
FIG. 2

DOUBLE NEEDLE BAR TUFTING APPARATUS FOR THE FORMATION OF LOOP PILE AND CUT PILE

BACKGROUND OF THE INVENTION

This invention relates to a multiple needle tufting machine for forming loop pile and cut pile, and more particularly to a tufting machine for forming loop pile behind cut pile simultaneously in the same fabric.

Heretofore, tufted fabrics including spaced rows of loop pile stitching and cut pile stitching have been formed in various ways. One method is to run a base fabric through a multiple needle tufting machine to form spaced rows of cut pile stitching and then run the same fabric through a second tufting machine to form rows of cut pile stitching in a predetermined pattern relative to the cut pile stitching.

Another method of forming rows of cut pile stitching and rows of loop pile stitching is disclosed in the prior U.S. Pat. No. 3,019,748 of J. L. Card, issued Feb. 6, 1962, in which loop pile hooks are transversely offset from the cut pile hooks and the loop pile hooks are provided with loop stripping fingers since the bills are pointed in the same direction.

The U.S. McCutchen Pat. No. 2,879,729 discloses a pair of loopers pointing toward each other and adapted to be moved toward and away from each other to cooperate with a single needle, but the loopers do not move toward and away from each other simultaneously, and one looper is designed to catch and hold the loop for engagement by the other looper.

The U.S. Fedevich Pat. No. 2,889,791 discloses two rows of staggered needles and a pair of corresponding rows of looper hooks. However, the looper hooks are pointing in the same direction to form only loop pile.

The U.S. Nowicki Pat. No. 2,990,792 discloses a row of cut pile hooks behind a row of loop pile hooks with the corresponding bills pointing toward each other, and adapted to move toward and away from each other. However, the bills of the loop pile hooks are spaced above the bills of the cut pile hooks, so that the hooks cooperate with different yarn loops passing through vertically spaced eyes in the same needle, so that one row of loop pile is stitched or superimposed upon another row of cut pile loops.

The U.S. Gebert Pat. 3,025,807 discloses a row of front needles and a row of rear needles spaced behind the front needles in a multiple needle tufting machine. The looper apparatus includes a unitary looper bracket supporting a plurality of transversely spaced cut pile hooks in front of a transversely spaced row of loop pile hooks. The cut pile hooks are adapted to cooperate with the front needles, and the loop pile hooks having bills pointing rearwardly in the opposite direction from the cut pile hook bills are adapted to cooperate with the corresponding rear needles. However, in Gebert, the front and rear needles are mounted and driven in alternate reciprocation relative to each other, while both the cut pile hooks and the loop pile hooks move simultaneously together in the same direction. Thus, either the cut pile hooks operate with the front needles in their lowermost position while the rear needles are raised, or the rear loop pile hooks cooperate with the rear needles in their lowermost position while the front needles are raised.

The U.S. Dedmon et al Pat. 3,241,507, in FIGS. 5–15, disclose a cut pile hook selectively alternating with a loop pile hook having a reverse bend to form either cut pile or loop pile in the same row of stitching.

In prior U.S. Pat. No. 3,919,953 of Roy T. Card et al, issued Nov. 18, 1975, spaced rows of loop pile and cut pile are formed upon front and rear staggered needles, respectively, supported in the same transverse needle bar. The looper apparatus includes front loop pile hooks and rear cut pile hooks, the bills of which point toward each other for cooperation with the corresponding front and rear staggered needles. The loopers are driven so that they move simultaneously toward each other to cooperate with the needles in their lowermost position, or simultaneously away from each other when the needles are in their elevated position.

When tufted fabrics are formed with the apparatus disclosed in the R. T. Card Pat. 3,919,953, occasionally, the rear needles which cooperate with the cut pile hooks strike a previously formed loop pile tuft formed by the loop pile hooks, disrupting the uniformity or the pattern of the pile in the fabric. Such disruption, referred to as "tagging", may be caused by the rear needle either driving the caught loop pile loop deeper into the fabric, or breaking the yarn or the fibers in the yarn.

SUMMARY OF THE INVENTION

It is therefore an object of this invention to provide a tufting machine capable of forming both loop pile and cut pile in the same base fabric simultaneously in which the loop pile is formed in a transverse row behind a transverse row of cut pile, in order to avoid the problem of the rear needles striking or tagging the front loops. In such an arrangement, the rear needles can only strike the tufts or loops which have already been cut. The uncut loops move rearwardly from the rear needles and away from both sets of needles as the base fabric moves in the feeding direction through the tufting machine.

It is another object of this invention to provide in a multiple needle tufting machine a pair of needle bars supporting transverse rows of front and rear needles which penetrate the fabric simultaneously and cooperate with their respective front cut pile hooks and rear loop pile hooks to form a front row of cut pile tufts and a rearwardly spaced row of loop pile tufts simultaneously in the same base fabric.

Another object of this invention is to provide a looper apparatus including front cut pile hooks and rear loop pile hooks for cooperating simultaneously with the corresponding front and rear needles in which a separate fabric support or needle plate is provided for each row of needles. A conventional needle plate is utilized for cooperation with the front needles in order to form cut pile, while a unique arrangement of loop pile needle plate fingers are supported on the cut pile hooks for supporting the base fabric adjacent the rear needles, as the rear needles penetrate the base fabric.

Because of the utilization of longitudinally spaced double needle bars and their cooperating hook bars and hooks, a certain degree of independence is achieved between the formation of the cut pile tufts. Accordingly, the front and rear needles may be in alignment with each other in the longitudinal feeding direction of the fabric, or they may be staggered. Furthermore, the front needle gauge and the rear needle gauge may be equal, or they may be different. Thus, while the front needles are forming the cut pile tufts with their cooperating cut pile hooks and knives, to form a cut pile background in the base fabric, the number and gauge of the rear needles and their corresponding loop pile hooks may have numerous variations to produce various patterns in the cut pile background of the same base fabric.

Each needle bar may be transversely, slidably mounted and controlled separately to shift the needles and yarns carried by the respective needles to form additional patterns in the base fabric.

Furthermore, although in many prior tufting machines in which loop pile and cut pile are formed by backrobbing the yarn, the cut pile is higher than the loop pile, in the double needle bar tufting apparatus made in accordance with this invention, the loop pile may be equal to or lower or higher than the cut pile.

Another object of this invention is to provide a double needle bar tufting apparatus utilizing essentially conventional cut pile hooks and knives in the front of the looper apparatus with the bills pointing forward, and a separate loop pile hook bar and loop pile hooks spaced behind the cut pile hook bar with the bills of the loop pile hooks pointing rearward. Each loop pile hook is in the form of a forwardly projecting shank having a reverse bend or U-shaped front end portion incorporating a rearward projecting bill pointing in the opposite direction from the cut pile hook bill and adapted to cooperate with each of the corresponding rear needles.

BRIEF DESCRIPTION OF THE DRAWINGS

FIG. 2 is a fragmentary, front elevational view of the left-hand portion of the tufting machine disclosed in FIG. 1, with portions broken away;

FIG. 4 is an enlarged fragmentary section taken along the line 4—4 of FIG. 2;

DESCRIPTION OF THE PREFERRED EMBODIMENTS

Figure 1:
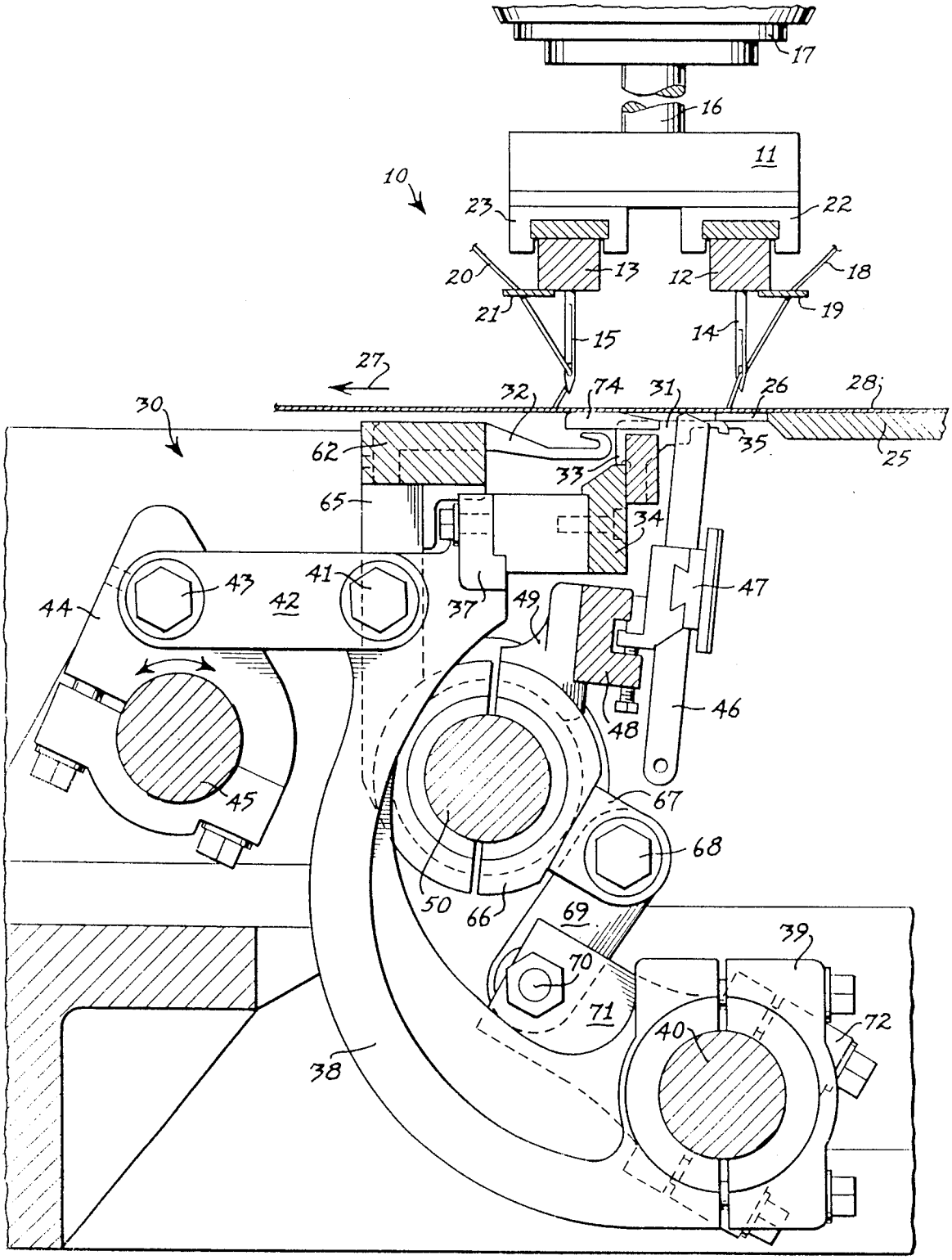
FIG. 1 is a fragmentary, sectional elevation of a portion of a tufting machine incorporating this invention, disclosing the needles and the hooks in their retracted, inoperative positions.

Referring now to the drawings in more detail, FIG. 1 discloses a multiple needle tufting machine 10 including an elongated transverse needle bar carrier 11 supporting a front needle bar 12 and a rear needle bar 13. The front needle bar 12 supports a row of transversely spaced front needles 14, while the rear needle bar 13 supports a row of transversely spaced rear needles 15. The needle bar carrier 11 is connected to a plurality of push rods 16 adapted to be vertically reciprocated by conventional needle drive mechanism, not shown, within the upper housing 17.

Front yarns 18 are supplied to the corresponding front needles 14 through corresponding apertures in the front yarn guide plate 19 from a source of yarn supply, not shown, such as yarn feed rolls, creels, pattern control mechanisms, or other known yarn supply means. In the same manner, rear yarns 20 are supplied to the corresponding rear needles 15 through corresponding apertures in the rear yarn guide plate 21 from another source of supply for the yarns, not shown.

The front and rear needle bars 12 and 13 may be fixedly mounted to the needle bar carrier 11, or, as illustrated in FIG. 1, they may be slidably mounted within the needle bar carrier 11 by the needle bar guides 22 and 23 for transverse or lateral shifting movement by appropriate pattern control means, not shown, in a well-known manner.

Supported upon the front needle plate 25 having rearward projecting, transversely spaced, front needle plate fingers 26 for longitudinal movement from front-to-rear in a feeding direction, indicated by the arrow 27, through the tufting machine 10 is the base fabric 28.

The needle drive mechanism, not shown, is designed to actuate the push rod 16 to vertically reciprocate the pair of needle bars 12 and 13 to cause the front and rear needles 14 and 15 to simultaneously penetrate the base fabric 28 far enough to carry the respective yarns 18 and 20 through the base fabric to form loops therein. After the loops are formed, the needles 14 and 15 are vertically withdrawn to their elevated, retracted positions disclosed in FIGS. 1 and 2.

The looper apparatus 30 made in accordance with this invention includes a plurality of front cut pile hooks 31 and a plurality of transversely spaced rear loop pile hooks 32, there being one cut pile hook 31 for each front needle 14, and one loop pile hook 32 for each rear needle 15.

Each cut pile hook 31 is provided with a shank 33 received in a corresponding slot in a cut pile hook bar 34 in a conventional manner for the assembly of cut pile hooks in a cut pile hook bar. The cut pile hooks 31 have the same transverse spacing or gauge as the front needles 14 and are so arranged that the bill 35 of each cut pile hook 31 is adapted to cross and engage its corresponding front needle 14 when the front needle 14 is in its lowermost position, as disclosed in FIG. 5, to seize the yarn 18 and form a loop therein. The bills 35 of the cut pile hooks 31 point forward in the direction opposite from the direction of fabric feed 27.

The elongated, transverse cut pile hook bar 34 is fixed to a bracket 37 mounted on the upper end portion of a C-shaped rocker arm 38. The lower end of the rocker arm 38 is fixed by a clamp bracket 39 to a transverse idler shaft 40. The upper portion of the rocker arm 38 is connected by a pivot pin 41 to a link bar 42, the opposite end of which is connected by a pivot pin 43 to a radial arm 44 clamped to a driven looper shaft or jack shaft 45. The looper shaft 45 is driven or reciprocably rotated by conventional looper drive means, not shown, operatively connected to the needle drive mechanism which reciprocates the needle push rod 16.

Adapted to cooperate with each cut pile hook 31 is a knife 46 supported in a knife holder 47. The knife holder 47 is fixed to a knife block 48 which in turn is fixed by bracket 49 to the knife shaft 50 adapted to be reciprocably rotated in timed relationship with the driven looper shaft 45, by means, not shown, in a conventional manner. As disclosed in FIG. 4, each knife 46 is adapted to cut loops 52 formed by each front needle 14 upon the bill 35 of the cut pile hook 31 from the front yarn 18 while the cut pile hook 31 is in its rearmost in operative or retracted position, to form the cut pile tufts 53.

Each of the loop pile hooks 32 is generally elongated extenling forwardly, and includes an elongated shank 55 having a rear depending tang 56 and a forward reverse looped portion 57 having a bill 58 projecting rearward and terminating in a free-bent end portion 60. The free-bent end portion 60 extends at an angle toward its corresponding rear needle 15 from the bill 58.

Figure 5:
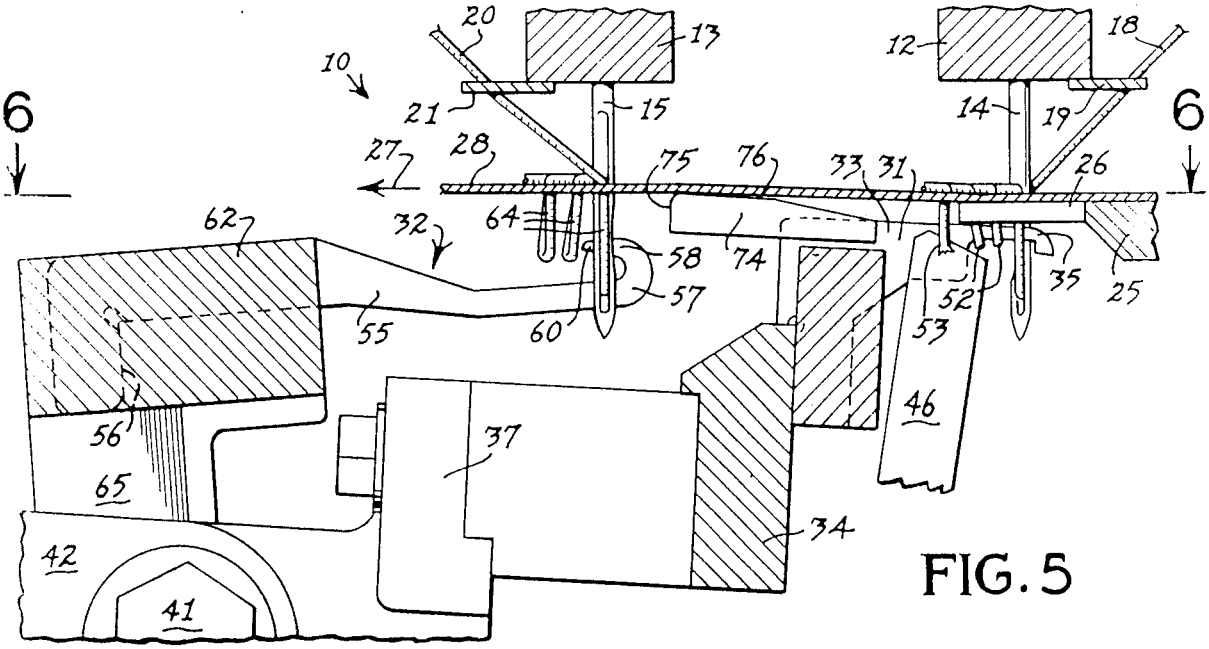
FIG. 5 is an enlarged fragmentary, sectional elevation similar to FIG. 4 with the needles and hooks in their operative loop-forming positions.
Figure 8:
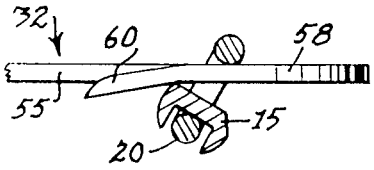
FIG. 8 is a greatly enlarged fragmentary plan view of a looper hook cooperating with a rear needle disclosed in section, to form a loop pile tuft.

The loop pile hook 32 is preferably made out of a unitary piece of spring steel of uniform narrow thickness. The tang 56 and rear portion of the shank 55 are mounted in a slot 61 (FIG. 6) in the loop pile hook bar 62. The slots 61 in the hook bar 62 preferably have the same uniform spacing or gauge as the rear needles 15. The loop pile hooks 32 are mounted in such a way that the shank 55 extends forward a substantial distance from the transverse loop pile hook bar 62 so that the reverse loop portion 57 projects forward beyond the vertical, reciprocable path of its corresponding needle 15, either in its forward or retracted positions, as shown in FIGS. 4 and 5. Thus, the bill 58 and the free-bent end portion 60 are either in front of the rear needle 15 in the retracted, inoperative position of the hook 32 (FIG. 4), or spanning the corresponding needle 15 in its lowermost position for seizing and forming a loop 64 from the yarn 20, as best disclosed in FIGS. 5 and 8.

The transverse loop pile hook bar 62 is fixed to the upper end of a bracket arm 65, the lower portion of which is integral with or fixed to a cylindrical collar 66 freely journaled or floating circumferentially upon the knife shaft 50. The opposite side, or lower portion, of the floating collar 66, is provided with a fixed radial arm 67 pivotally connected by a pin 68 to a link bar 69. The opposite end of the link bar 69 is pivotally connected by a pin 70 to a bracket arm 71 provided with a clamp 72 fixed to the idler shaft 40.

Thus, it will be seen that when the driven looper shaft 45 is rotated in one direction, such as a clockwise direction in FIG. 1, the cut pile hooks 31 will be moved forward to their operative positions crossing their corresponding front needles 14 in their lowermost position for forming the loops 52. Such rotation will cause the rocker arms 38 to rotate the idler shaft 40 also in a clockwise position, causing the floating collar 66 to rotate in a counter-clockwise direction forcing the loop pile hooks 32 rearwardly, also to cross their corresponding rear needles 15 in their lowermost positions for forming the loop pile loops 64 (FIG. 5). Simultaneously, through mechanisms not shown, the knife shaft 50 will also be rotating in a clockwise direction to lower the knives 46 away from cutting engagement with the bills 35 of the cut pile hooks 31 (FIG. 5).

Rotation of the looper shaft 45 in the opposite or counter-clockwise direction will cause the idler shaft 40 to also rotate in a counter-clockwise direction so that the cut pile hooks 31 and the loop pile hooks 32 will be moved toward each other, toward their retracted positions of FIGS. 1 and 4 as the needles 14 and 15 rise from the base fabric 28 in their retracted inoperative positions. In this position the knives 46 rise to cut the loops 52 seized on the cut pile hooks 31 to form cut pile tufts 53.

Another important feature of this invention is the fixation of a plurality of loop pile needle plate fingers 74 to corresponding cut pile hooks 31. Each of the fingers 74 projects rearwardly from its corresponding cut pile hook 31 and terminates in a free end portion 75 in the vicinity of and preferably adjacent the vertical path of each corresponding rear needle 15, as best disclosed in FIGS. 1 and 4. Each needle plate finger 74 is provided with an elongated top edge or ledge located at preferably the same elevation as the top edges of the needle plate fingers 26 so that the top edges 76 will bear against the lower surface of the base fabric 28 to support the base fabric 28 adjacent the rear needles 15, particularly as the rear needles 15 descend to penetrate through the base fabric 28. Each needle plate finger 74 may be fixed to the shank 33 of its corresponding cut pile hook 31. Alternatively, each needle plate finger 74 may be fixed to the cut pile hook bar 34. Accordingly, each needle plate finger 74 will reciprocate with the corresponding cut pile hook 31, as disclosed in FIGS. 4 and 5.

It will be noted in FIG. 5 that after the rear needles 15 have descended through the base fabric 28 and are in their loop-forming positions cooperating with the loop pile hooks 32, the free ends 75 of the loop pile needle plate fingers 74 have moved forward of the needles 15 and out of the way of the needles 15, yarns 20, and loops 64, as well as the loop end portions 57 of the looppile hook 32. Yet the loop pile needle plate fingers 74 are still close enough to the rear needles 15 to support the base fabric 28 in an area forward of the rear needles 15.

The loop pile needle plate fingers 74 are preferably of uniform thickness, being thin relative to the height of the needle plate fingers 74 and being substantially planar. The front end portions of the needle plate fingers 74 may be secured to the upper shank portions 33 of the cut pile hooks 31 by welding or soldering.

Accordingly, each of the cut pile and loop pile forming stations are provided with their own separate needle plate fingers 26 and 74, respectively.

Figure 3:
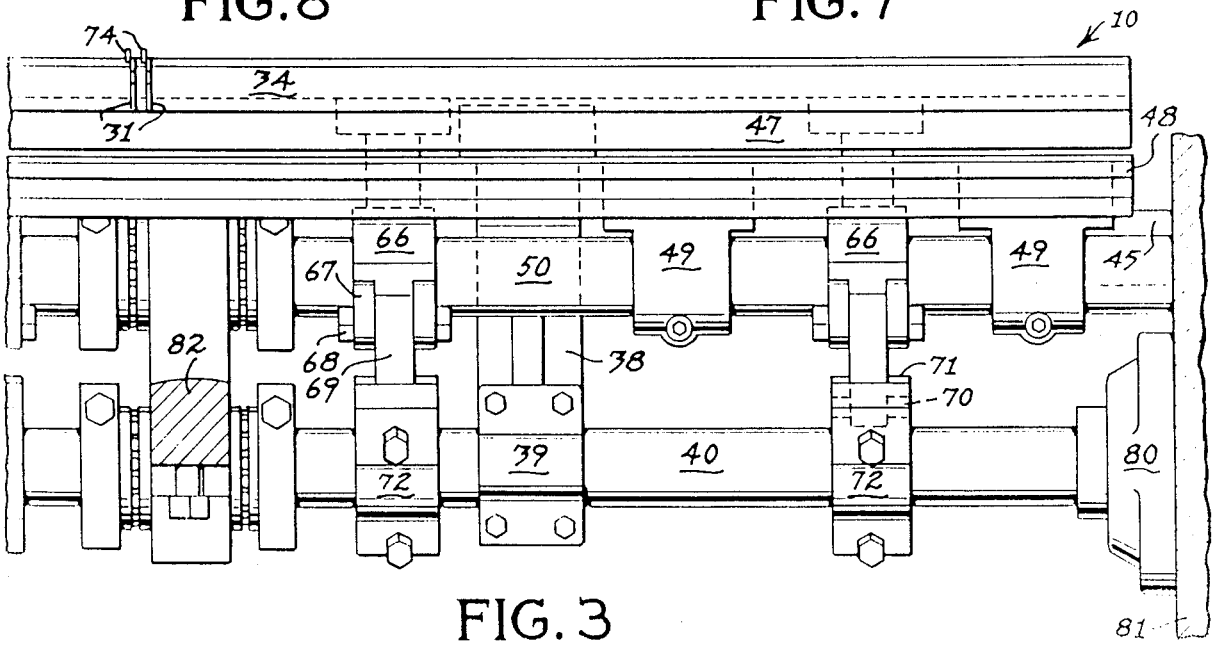
FIG. 3 is a fragmentary, front elevational view of the right-hand portion of the tufting machine disclosed in FIG. 1.

As best disclosed in FIGS. 2 and 3, the idler shaft 40 is journaled for free rotary movement in end bearings 80 fixed on the machine frame 81. The idler shaft 40 may also be formed in shorter aligned shaft sections and journaled in intermediate bearings 82 (FIG. 3), if desired. The knife shaft 50 and the jack shaft 45 are also journaled in the machine frame 81 in a conventional manner.

In the operation of the machine 10, the base fabric 28 is fed from front-to-rear through the machine 10 in the direction of the arrow 27 beneath the needles 14 and 15 and over the needle plate 25, including its needle plate fingers 26, and over the reciprocable needle plate fingers 74. When the needles 14 and 15 are in their elevated or retracted positions disclosed in FIGS. 1 and 4, the corresponding cut pile hooks 31 and loop pile hooks 32 are in their retracted positions closely spaced to each other, also as illustrated in FIGS. 1 and 4. In the retracted positions of the hooks 31 and 32, the knife 46 has risen to its operative cutting position for cutting the loops seized by the cut pile hook 31 and forming the cut pile tufts 53, as illustrated in FIG. 4. The needles 14 and 15 then descend penetrating the base fabric 28 carrying with them the respective yarns 18 and 20. When the needles 14 and 15 descend to their lowermost position disclosed in FIG. 5, the respective hooks 31 and 32 are moved away from each other causing their respective bills 35 and 58 to cross their respective front and rear needles 14 and 15 to seize the yarns and form the respective loops 52 and 64. The needles 14 and 15 then rise again to the original elevated, retracted positions while the loops 52 are cut by the knives 46 on the cut pile hooks 31 in their retracted positions to form cut pile tufts 53, and the loops 64 slip rearward from the free end portions 60 of the loop pile hook bills 58 to form uncut loop pile.

It will be particularly noted that as the rear needles 15 descend through the base fabric 28, the loop pile needle plate fingers 74 are retracted to their rearmost position adjacent the needles 15 to provide maximum support for the base fabric 28.

Furthermore, it will be noted that by positioning the cut pile hooks 31 in front of the loop pile hooks 32, that all of the cut pile tufts 53 are formed in the base fabric 28 in front of the loop pile loops 64. Accordingly, as the loop pile loops 64 are formed in the base fabric, and since the base fabric 28 is moving rearwardly, the loop pile loops 64 immediately move away from any descending needles 14 or 15, while the cut pile tufts 53, which cannot be harmed by the descending needles, move beneath the reciprocating rear needles 15.

Accordingly, none of the uncut loop pile loops 64 are tagged or struck by any of the tufting needles, and thus remain relatively uniform in height and uninterrupted and undamaged.

Figure 6:
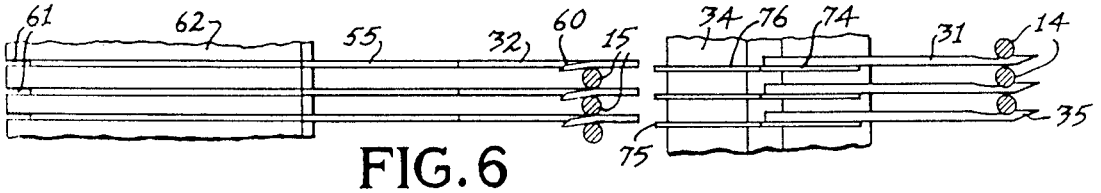
FIG. 6 is a fragmentary, sectional plan view taken along the line 6—6 of FIG. 5.
Figure 7:
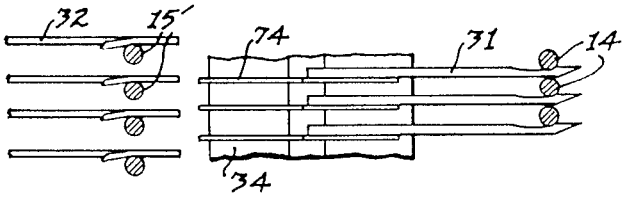
FIG. 7 is a fragmentary plan view similar to FIG. 6, illustrating a rear needle gauge larger than the front needle gauge.

As illustrated in FIG. 7, needles 15' are located on a coarse gauge, greater than the needle gauge of the front needles 14. Because of the structure of the machine 10, and particularly the separation of the front and rear needles 14 and 15 and the spacing between the cut pile hooks 31 and loop pile hooks 32, the needle gauges may be equal, as illustrated in FIG. 6, or may be unequal, as disclosed in FIG. 7, so that varying patterns may be formed in the base fabric 28.

Also, as disclosed in FIG. 1, the needle bars 12 and 13 may be laterally or transversely shifted independently of each other by appropriate needle bar shifting mechanisms, not shown, also well known in the art, in order to form varying zig-zag patterns in either or both the cut pile and loop pile stitching.

Moreover, because of the relative spacing between the various tufting elements, such as the needles, hooks and knives, forming the loop pile and the cut pile and the resulting independence between such formations, the loop pile loop 64 may be made longer than the cut pile tufts 53 by adjusting the vertical height of the loop pile hooks 32 or the loop pile hook bar 62 by structures, not shown, well known in the art, for varying the height of looper hooks.

Furthermore, the front needles 14 and the rear needles 15 may be in longitudinal alignment in the feeding direction 27, as shown in FIG. 6, or the front and rear needles 14 and 15 may be staggered, or a few or many of the rear needles 15 may be omitted entirely, in order to intersperse a cut pile background with tufted loops 64 in varying patterns.

The upward and downward movement of the front needles 14 and rear needles 15 together provide a more controlled and stable tufting operation as opposed to the alternate reciprocal vertical movement of the needles. When the front and rear needles penetrate the fabric together the portion of the base fabric 28 between the needles is fixed. On the other hand, where a front needle penetrates the fabric to form a cut pile tuft and a rear needle rises, the rising rear needle tends to pull up the fabric with the needle which action may cause wrinkling and irregular tufting.

What is claimed is:

1. A tufting machine for the formation of loop pile and cut pile, comprising:

(a) means for supporting a base fabric for longitudinal movement in a feeding direction from front-to-rear through the machine, (b) a front needle bar supporting a plurality of front needles spaced transversely of said feeding direction for introducing yarns through said base fabric to form loops, (c) a rear needle bar spaced behind said front needle bar in said feeding direction and supporting a plurality of rear needles spaced transversely of said feeding direction for introducing yarns through said base fabric to form loops, (d) needle drive means supporting said needle bars for simultaneous reciprocal movement toward and away from said base fabric, (e) looper apparatus comprising a plurality of loop pile hooks and a plurality of cut pile hooks, there being one hook for each of said needles, (f) said looper apparatus comprising means mounting said cut pile hooks adjacent said fabric supporting means so that the bills of said cut pile hooks point in the direction opposite said feeding direction and each of said cut pile hooks cooperates with a front needle to form a cut pile loop, (g) knife means for reciprocal, cooperative movement with a corresponding cut pile hook to cut a cut pile loop and form a cut pile tuft, (h) said looper apparatus further comprising means mounting said loop pile hooks spaced behind said cut pile hooks in said feeding direction so that the bills of said cut pile hooks point in said feeding direction and in the opposite direction from the bills of said cut pile hooks, each of said loop pile hooks cooperating with a rear needle to form a loop pile loop, (i) said looper apparatus further comprising reciprocal motive means for moving said loop pile hooks and said cut pile hooks simultaneously away from each other to cooperate with said respective front and rear needles in a lowermost reciprocal position penetrating the base fabric to form said respective loops, and for moving said loop pile hooks and said cut pile hooks simultaneously toward each other when said front and rear needles are in an elevated position to release and cut said respective loops, in order to simultaneously form loop pile loops behind said cut pile tufts.

2. The invention according to claim 1 further comprising a plurality of loop pile needle plate fingers, each of said needle plate fingers being fixed relative to a cut pile hook, each of said needle plate fingers projecting rearwardly from said corresponding cut pile hook and terminating in a free end adjacent the reciprocal path of a corresponding rear needle, said loop pile needle plate fingers being adapted to support said base fabric as the fabric moves in said feeding direction beneath said rear needles.

3. The invention according to claim 2 in which each of said needle plate fingers includes a front portion fixed to a corresponding cut pile hook.

4. The invention according to claim 1 in which said means mounting said loop pile hooks comprises a transverse loop pile hook bar and means mounting said loop pile hook bar behind said rear needles for reciprocable movement, each of said loop pile hooks comprising an elongated shank portion projecting forwardly from said loop pile hook bar beyond said reciprocable paths of said rear needles and terminating in a reverse hook portion comprising a rearwardly projecting bill, said bill being adapted to reciprocably move across a corresponding rear needle to cooperate with said needle to form a loop pile loop.

5. The invention according to claim 4 in which said bill comprises a free end portion transversely bent toward the reciprocable path of said corresponding rear needle for engaging said needle in its lowermost position in order to seize a yarn carried by said needle to form said loop pile loop.

6. The invention according to claim 4 in which said looper apparatus comprises a driven, reciprocably rotating, transverse looper shaft, said means mounting said cut pile hooks comprises a transverse cut pile hook bar, and link means operatively connecting said driven looper shaft with each of said hook bars to cause said hook bars to move away from each other when said driven looper shaft rotates in one direction and to move said hook bars toward each other when said driven looper shaft rotates in the opposite direction.

7. The invention according to claim 6 in which said knife means comprises a transverse driven reciprocable knife shaft, a transverse knife bar fixed to said knife shaft, said knife bar supporting a plurality of knives, each knife adapted to cooperate with a corresponding cut pile hook, said means mounting said loop pile hooks further comprising a collar freely rotatable upon said knife shaft, said loop pile hook bar being fixedly attached to said collar, said link means connecting said driven looper shaft to said cut pile hook bar and said collar whereby said collar is adapted to simultaneously rotate in the opposite direction from said driven looper shaft.

8. The invention according to claim 7 further comprising an idler shaft, a first lever arm having one end clamped to said idler shaft and the other end fixed to said cut pile hook bar, a link bar pivotally connecting said first lever arm to said driven looper shaft, a second lever arm clamped to said idler shaft and a second link bar pivotally connecting said second lever arm to said collar.

9. The invention according to claim 1 in which the gauge of said front needles is substantially equal to the gauge of said rear needles.

10. The invention according to claim 1 in which the gauge of said rear needles is greater than the gauge of said front needles.

11. The invention according to claim 2 in which each of said loop pile needle plate fingers are substantially straight and are uniformly spaced transversely apart a distance slightly greater than the transverse thickness of each of said rear needles.

12. The invention according to claim 11 in which each of said loop pile needle plate fingers has an elongated top surface at an elevation for supporting the base fabric moving through said machine in said feeding direction for penetration by said rear needles.

13. The invention according to claim 12 in which said means for supporting a base fabric comprises a needle plate having a plurality of cut pile needle plate fingers projecting rearwardly in the reciprocal path of said front needles, said cut pile needle plate fingers having top surfaces at substantially the same elevation as the top surfaces of said loop pile needle plate fingers.

* * * * *